US008910844B2

(12) United States Patent
Rowe et al.

(10) Patent No.: US 8,910,844 B2
(45) Date of Patent: Dec. 16, 2014

(54) BACKPACK WITH SIDE ACCESS

(75) Inventors: Michael Rowe, Kettering, OH (US); Edward Busam, Mason, OH (US); Kevin Witter, Centerville, OH (US); Trisha Maurer, New Bremen, OH (US); Kyley Reed, Troy, OH (US); Amy Bryant, Dayton, OH (US); Thomas Africa, Lebanon, OH (US); Sherry Jones, Pataskala, OH (US); Harlan Peden, Sunbury, OH (US); Elizabeth Taylor, Bexley, OH (US)

(73) Assignee: ACCO Brands Corporation, Lake Zurich, IL (US)

( * ) Notice: Subject to any disclaimer, the term of this patent is extended or adjusted under 35 U.S.C. 154(b) by 931 days.

(21) Appl. No.: 12/262,403

(22) Filed: Oct. 31, 2008

(65) Prior Publication Data

US 2010/0108731 A1 May 6, 2010

(51) Int. Cl.
*A45F 3/04* (2006.01)
*A45C 13/10* (2006.01)

(52) U.S. Cl.
CPC ..... *A45F 3/042* (2013.01); *A45C 13/103* (2013.01)
USPC ..... 224/655; 224/654

(58) Field of Classification Search
USPC ..... 224/645, 654–655; 383/41; 190/1, 112; 206/268, 288; D3/216–217
See application file for complete search history.

(56) References Cited

U.S. PATENT DOCUMENTS

| | | | | | |
|---|---|---|---|---|---|
| D106,446 | S | * | 10/1937 | Laufman, B. | D3/283 |
| 3,708,045 | A | * | 1/1973 | Katz | 190/115 |
| 4,236,615 | A | * | 12/1980 | Ginat | 190/111 |
| 4,817,802 | A | * | 4/1989 | Pratt | 206/579 |
| 5,042,664 | A | * | 8/1991 | Shyr et al. | 206/579 |
| 5,090,526 | A | * | 2/1992 | Jacober | 190/107 |
| 5,323,897 | A | * | 6/1994 | Sperber | 206/287 |
| 5,494,157 | A | * | 2/1996 | Golenz et al. | 206/320 |
| 5,544,792 | A | * | 8/1996 | Arnwine | 224/153 |
| D402,460 | S | | 12/1998 | Moor | |
| 5,881,932 | A | * | 3/1999 | Wadden | 224/153 |
| 6,053,382 | A | | 4/2000 | Wyant | |
| 6,286,461 | B1 | * | 9/2001 | Martz | 119/497 |
| 6,354,477 | B1 | * | 3/2002 | Trummer | 224/575 |
| 6,435,390 | B1 | | 8/2002 | Abramowicz | |
| 6,481,574 | B1 | * | 11/2002 | Pakosh | 206/285 |
| 6,516,751 | B2 | * | 2/2003 | Burns et al. | 119/497 |
| D508,315 | S | * | 8/2005 | Han | D3/217 |
| 6,994,132 | B2 | * | 2/2006 | Antrobus | 150/107 |
| 7,419,037 | B2 | * | 9/2008 | Nordstrom | 190/107 |
| 7,481,317 | B2 | * | 1/2009 | Brim, III | 206/576 |

(Continued)

FOREIGN PATENT DOCUMENTS

| | | |
|---|---|---|
| CA | 2180739 | 5/1996 |
| DE | 2022004015475 U | 2/2005 |

OTHER PUBLICATIONS

OGIO Locker Bag Reference.

*Primary Examiner* — Brian D Nash
*Assistant Examiner* — John Cogill
(74) *Attorney, Agent, or Firm* — Thompson Hine L.L.P.

(57) ABSTRACT

A backpack for providing improved user access points. In particular a backpack providing for side entry into the contents. The backpack may utilize an S-shape zipper to improve access. The backpack may have multiple ways to access the inner pocket, including top access and dual side access.

22 Claims, 6 Drawing Sheets

(56) References Cited

U.S. PATENT DOCUMENTS

2003/0024960 A1* 2/2003 Greenstein et al. ..... 224/153
2003/0127060 A1* 7/2003 Yeung ..... 119/497
2004/0182901 A1 9/2004 Godshaw et al.
2009/0032418 A1* 2/2009 Hamilton ..... 206/315.9
2010/0051659 A1* 3/2010 Ferrari ..... 224/197

* cited by examiner

BACKPACK WITH SIDE ACCESS

BACKGROUND

Backpacks are widely used by students and other users to store books, school supplies, travel supplies, etc. However, due to various physical constraints, it may be difficult to access the inner cavity of the backpack. For example, when an existing backpack is stored in the relatively narrow dimensions of a school locker, it can be difficult to access to the top/front of the backpack. Moreover, when a existing backpack is stacked adjacent to other components (i.e. in a luggage compartment or the like) it can be difficult to access the inner cavity. Accordingly, the present invention is directed to a backpack with improved side access.

DETAILED DESCRIPTION

Figure 1:
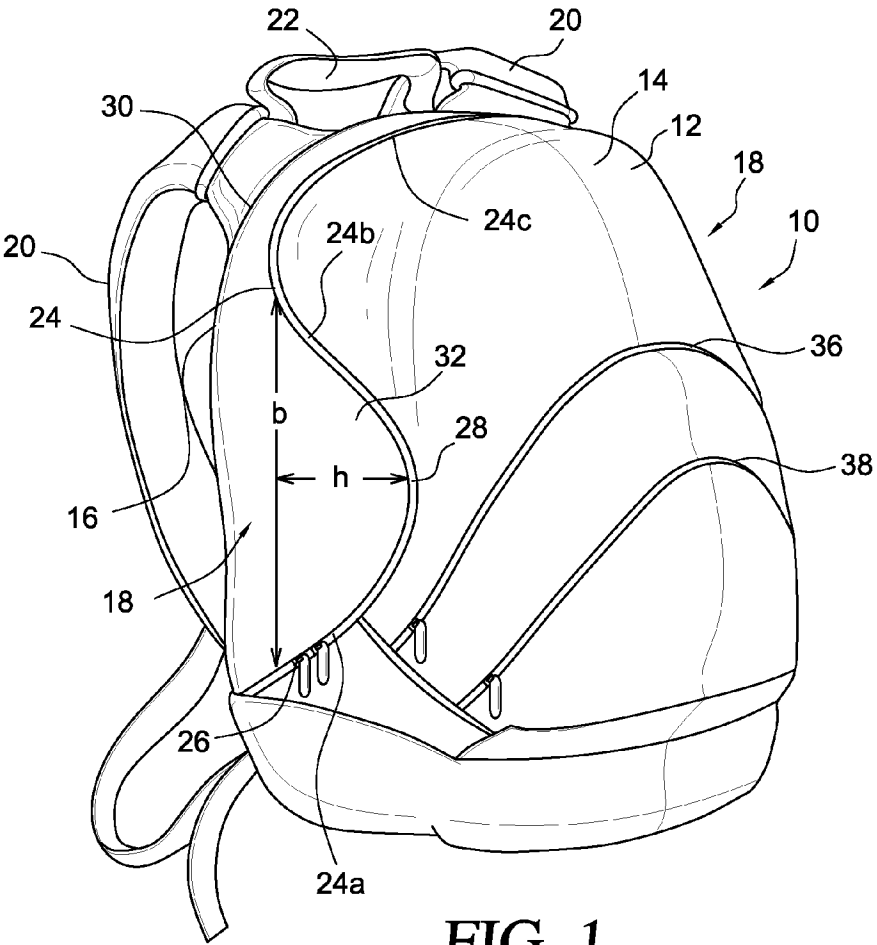
FIG. 1 is a front perspective view of one embodiment of the backpack of the present invention.

As shown in FIG. 1, in one embodiment the backpack 10 of the present invention includes a body 12 with an inner cavity, or major storage compartment 14, therein. The body 12 includes a back panel 16 configured to lie adjacent to the back of a wearer, a pair of opposed sides 18, and a pair of shoulder straps 20. Alternately, if desired, rather than using two shoulder straps 20, a single shoulder strap 20 may be utilized to provide a backpack 10 also known as a "sling." Each shoulder strap 20 extends from the top of the body 12/back panel 16 to the bottom of the body 12/back panel 16 to form a loop which can receive the wearer's arms therethrough. The backpack 10 is configured such that when it is worn by a wearer, the shoulder straps 20 are positioned over the shoulder of a wearer, the back panel 16 is positioned generally flat against the back of a wearer, and the sides 18 are positioned generally adjacent the sides of a wearer.

Each shoulder strap 20 can include cushioning or padding material (such as foam) thereon, and be of an adjustable length, to allow the backpack 10 to be carried on the back of the wearer in a well known manner. A carrying handle 22 may be positioned on the top of the body 12/back panel 16 between the shoulder straps 20 to provide a means by which the backpack 10 can be carried by hand. The body 12, shoulder straps 20 and handle 22 can all be made of a wide variety of flexible, durable sheet-like material, such as polymers (i.e. polyester, nylon), fabric, combinations of these materials, etc., in woven or various other forms.

A releasable fastener/closure 24 may extend around the body 12 such that when the releasable closure 24 is opened, access is thereby provided to the major storage compartment 14. The releasable closure 24 can take any of a variety of forms, including a zipper, a slide fastener, hook-and-loop fastening material (i.e. VELCRO®), snaps, magnets or the like.

In the illustrated embodiment, the releasable closure 24 has an end location 26 near the bottom of the body 12 (i.e. in the lower half of the body 12) and adjacent to the back panel 16 (i.e. within about 0-3 inches). From the end location 26, the releasable closure 24 has a first portion 24*a* that extends generally upwardly and outwardly (i.e. upwardly away from the back panel 16) to the outward-most position 28. The outward-most position 28 of the releasable closure 24 may be located in the outer half of the body 12 (i.e. in the half of the body 12 furthest away from the back panel 16) and/or at least about 3 inches, or at least about 4 inches, away from the back panel 16.

From the position 28, the releasable closure 24 has a second portion 24*b* that extends generally upwardly and inwardly towards the back panel 16 to an intermediate position 30 generally adjacent to the back panel 16 and/or one of the shoulder straps 20. The releasable closure 24 has a third portion 24*c* that extends upwardly and over the top of the body 12 at a distance generally uniformly spaced from the back panel 16 to the opposite side 18 of the body 12. The releasable closure 24 then continues on the opposite side 18 in the same pattern, or in a symmetrical or mirror image pattern, to that shown in FIG. 1. In this manner, the releasable closure 24 has a generally "S"-shape (or "reversed S" shape) in end view on both sides 18 of the body 12.

Figure 2:
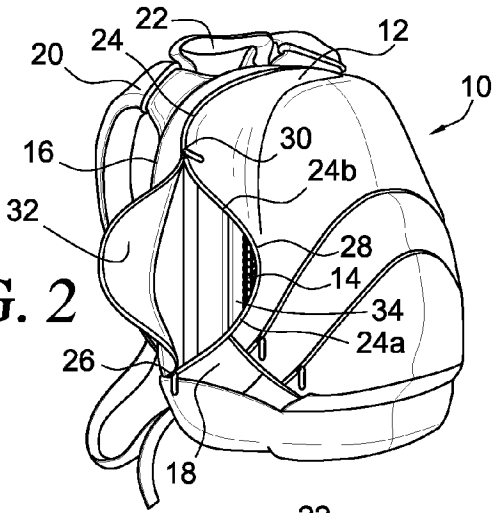
FIG. 2 is a detailed side view of the backpack of FIG. 1, with the releasable closure partially opened.

The serpentine shape of the releasable closure 24 allows for easy side access to the major storage compartment 14. In particular, as shown in FIG. 2, when the releasable closure 24 is unfastened to the intermediate position 30, a generally triangular side flap 32 is defined in the body 12. The side flap 32 can be pulled away from the rest of the body 12 to provide the side access opening 34 shown therein. In this manner, access is provided to the major storage compartment 14 by only partially releasing/opening the releasable closure 24. Moreover, the "S"-shape of the releasable closure 24 provides the side flap 32 which can be pivoted/folded away from the body 12 to define a definite opening 34. This can be contrasted with a simple "slit" opening provided by a linear releasable closure which does not provide the side flap or associated access and visibility.

Figure 3:
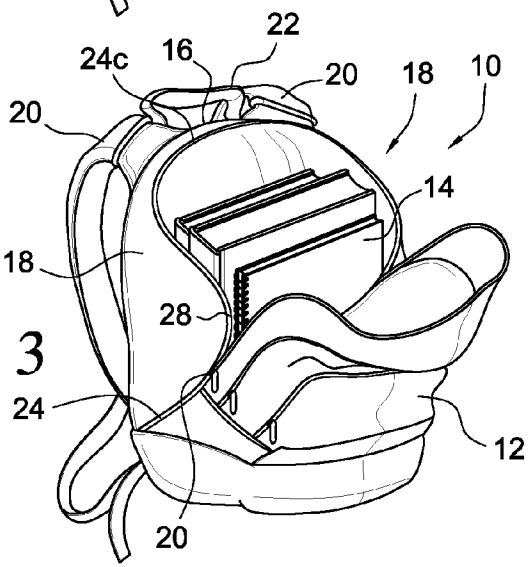
FIG. 3 is a top perspective view of the backpack of FIG. 1, with the releasable closure more fully opened.

As shown in FIG. 3, when full access is desired to the major storage compartment 14, the releasable closure 24 can be completely opened, thereby allowing access to the major storage 14 compartment via of the top of the body 12/backpack 10. Thus, the releasable closure 24 provides the option of side access to the major storage compartment 14 on either side 18 of the body 12/backpack 10, and also provides the option of full/top-access to the major storage compartment 14.

As shown in FIG. 1, various additional releasable fasteners/closures 36, 38 may extend across the front face of the body 12/backpack 10. In one embodiment, each releasable closure 36, 38 may provide access to the major storage compartment 14. Alternately, each releasable closure 36, 38 may provide access to an auxiliary storage compartment that is positioned adjacent to the major storage compartment 14.

Figure 5:
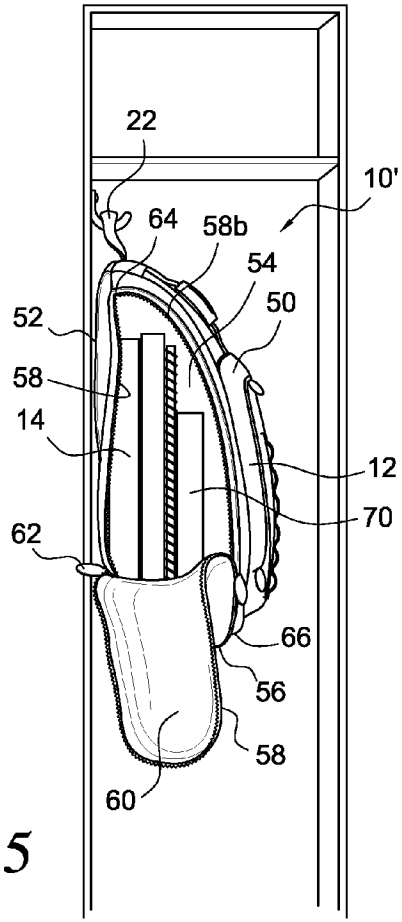
FIG. 5 is a side view of the backpack of FIG. 4, stored in the locker, with the releasable closure opened.
Figure 4:
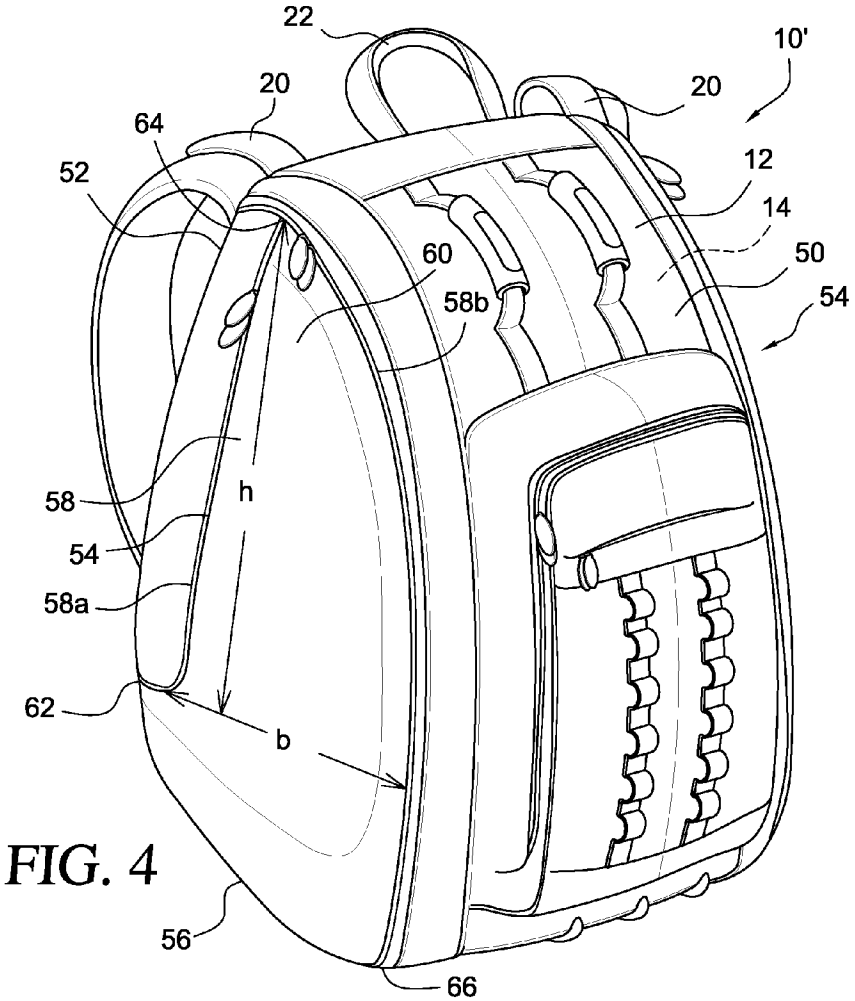
FIG. 4 is a front perspective view of another embodiment of the backpack of the present invention.
Figure 8:
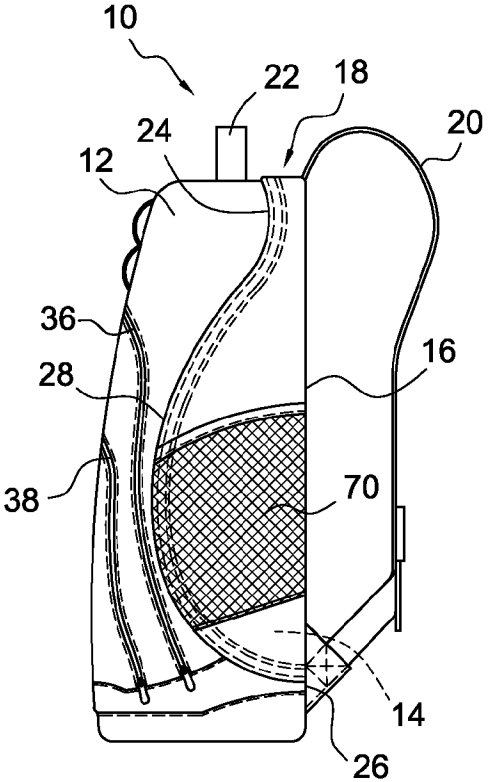
FIG. 8 is an opposite side view of the backpack of the FIG. 6.
Figure 7:
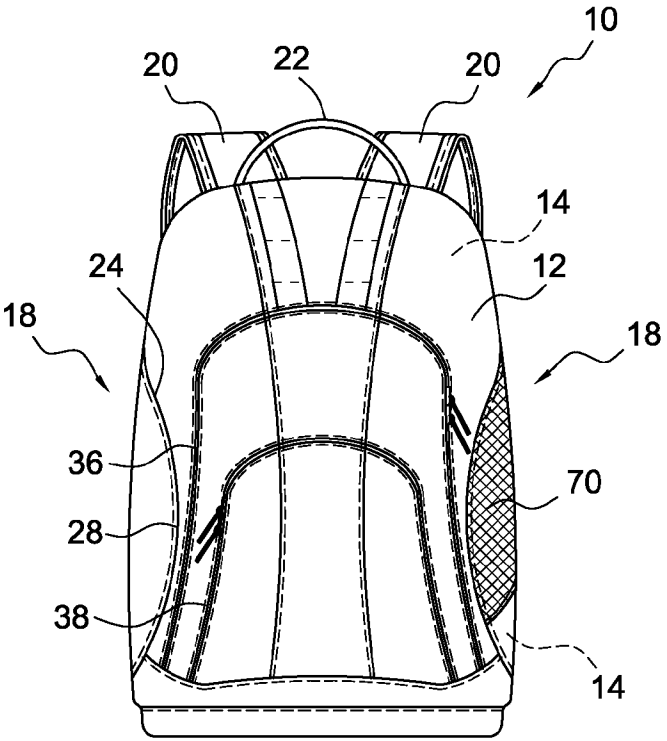
FIG. 7 is a front view of the backpack of the FIG. 6.
Figure 6:
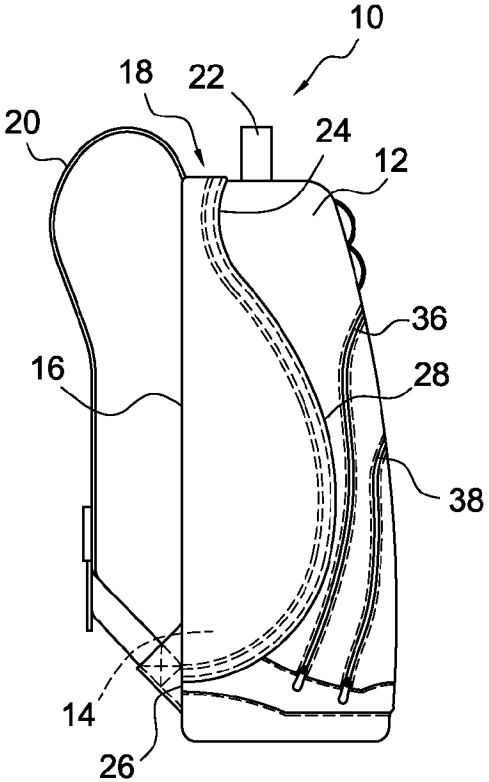
FIG. 6 is a side view of another embodiment of the backpack of the present invention.
Figure 11:
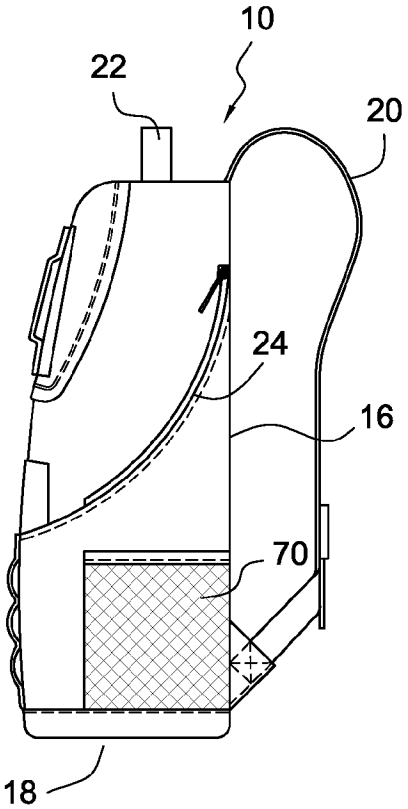
FIG. 11 is an opposite side view of the backpack of the FIG. 9.
Figure 10:
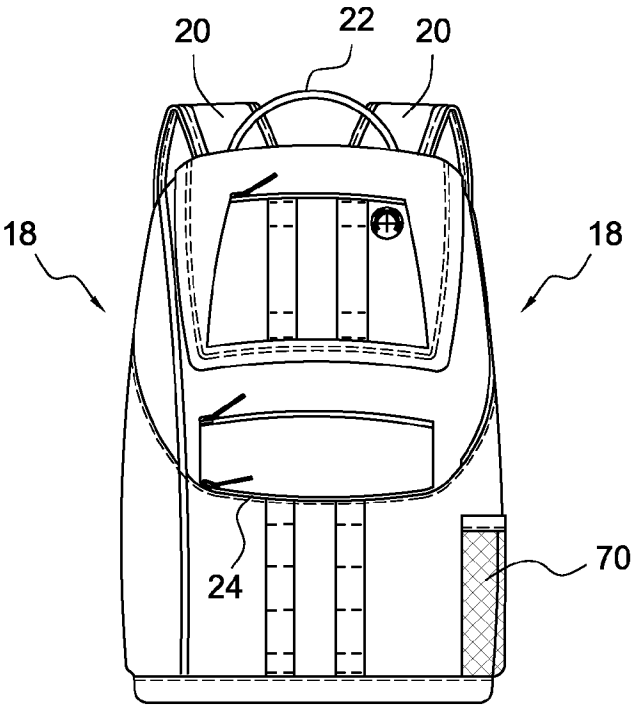
FIG. 10 is a front view of the backpack of the FIG. 9.
Figure 9:
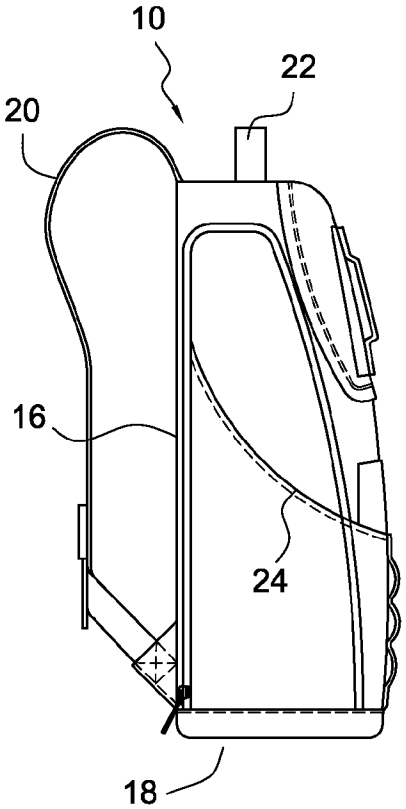
FIG. 9 is a side view of another embodiment of the backpack of the present invention.
Figure 14:
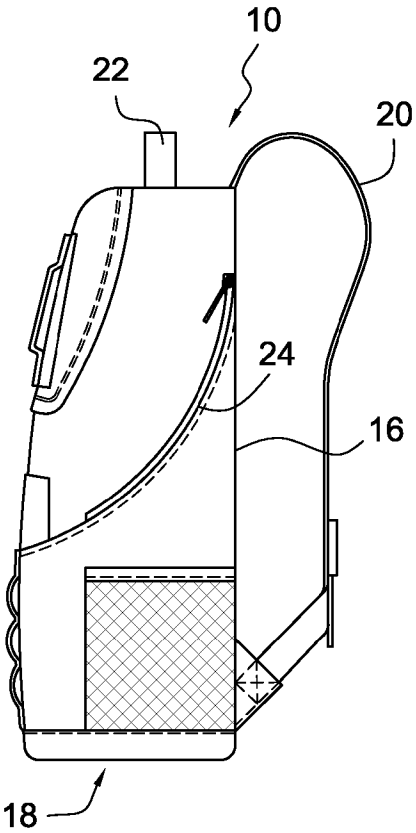
FIG. 14 is an opposite side view of the backpack of the FIG. 12.
Figure 13:
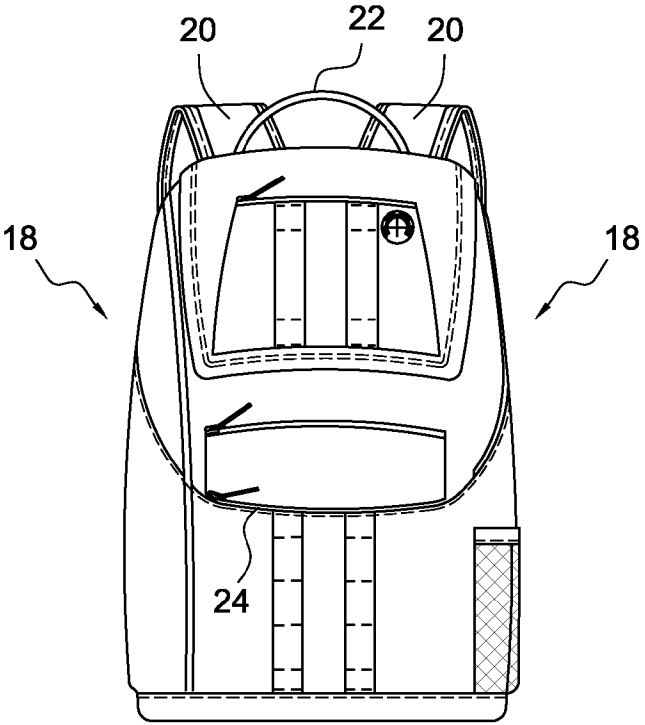
FIG. 13 is a front view of the backpack of the FIG. 12.
Figure 12:
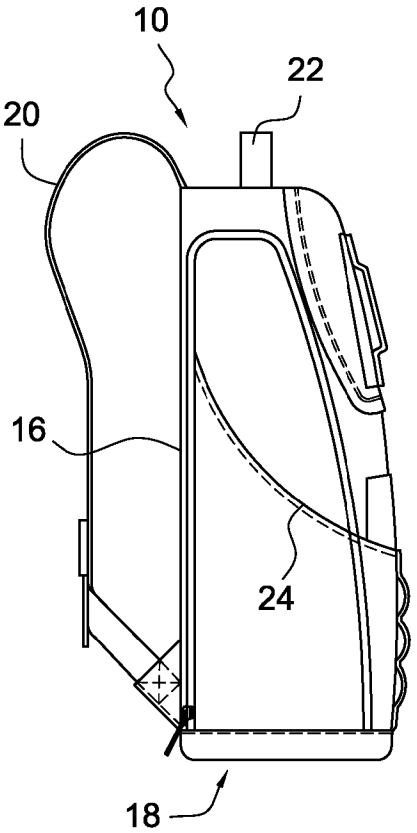
FIG. 12 is a side view of another embodiment of the backpack of the present invention.
Figure 16:
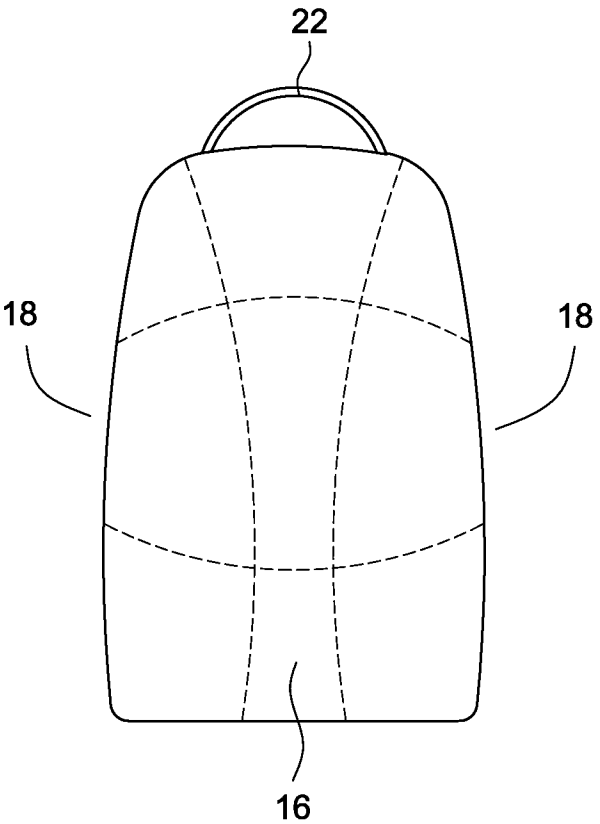
FIG. 16 is a back view of an embodiment of the backpack of the present invention without straps shown.
Figure 15:
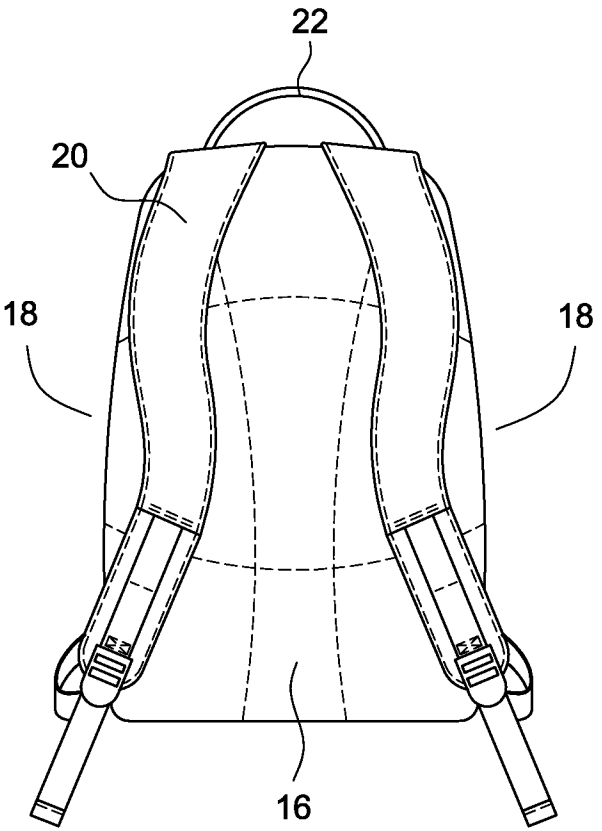
FIG. 15 is a back view of an embodiment of the backpack of the present invention.

FIGS. 4 and 5 illustrate an alternate embodiment of the invention. In this case, the backpack 10' includes a front panel 50, back panel 52, opposed side panels 54, and bottom panel 56. A releasable closure 58 is positioned on each side panel 54. Each releasable closure 58 extends around generally the entire perimeter of the associated side panel 54 in a generally closed loop to define a side flap 60. In particular, the releasable fastener 58 may have an inner end position 62, and have a first portion 58*a* extending generally upwardly to an upper-most position 64. The releasable closure 58 has a second portion 58*b* extending generally downwardly and outwardly from the upper-most position 64 to an outer end position 66 that is spaced outwardly from the inner end position 62.

When the releasable closure 58 is fully opened/released, as shown in FIG. 5, the side flap 60 is freed and generally pivotable/moveable away from the body 12 to provide a side access opening 70 for access to the major storage compartment 14. The side flap 60 defined by the releasable closure 58 may comprise a significant percentage (i.e. in one case, at least about 60 percent, and in another case, at least 80 percent) of the associated side panel 54 to provide ease of access when opened.

The releasable closure 58 on the side panel 54 may form a substantially, but not entirely, closed loop to prevent the side flap 60 from being completely separated from the backpack 10'. Although only a single side flap 60 is visible in FIGS. 4 and 5, it should be understood that both side panels 54 may include a side flap 54 so that side access to the major storage compartment 14 can be provided regardless of the orientation of the body 12/backpack 10'. If desired, a top access releasable closure (not shown) may be provided in the front panel 50 of the backpack 10' (i.e. immediately forward of the handle 22) to provide top/front access to the major storage compartment 14.

The releasable closure 24 in the embodiment of FIGS. 1-3 has first 24*a* and second 24*b* portions that form an angle therebetween of about 80 degrees, or less than about 100 degrees. Similarly, various portions of the releasable 58, or tangents thereof, in the embodiment of FIGS. 4 and 5 may form an angle of less than about 100 degrees to form a relatively well-defined side flap 66. Each side flap 32/60 may be foldable or pivotable about a root or base that is defined by end points of the releasable closure 24/58, or by sufficient changes in direction of the releasable closure 24/58 (see base b in FIGS. 1 and 4). Each base b may be relatively small to provide ease of pivoting/folding. For example, each base b may have a length that is less than about ½ or about ¾ the height of the side 18/54 of the backpack 10/10', or have a length that is no more than about four times as long as the height h of the side flap 32/60 (measured perpendicular to the base).

The attached sheets A-E further illustrate various details of certain embodiments of the invention. However, it should be understood that the various materials, dimensions, and features shown therein are illustrative examples, and the materials, dimensions, and feature can vary from those shown in sheets A-E without departing from the scope of the invention.

Having described the invention in detail and by reference to the various embodiments, it will be apparent that modifications and variations thereof are possible without departing from the scope of the invention.

The invention claimed is:

1. A backpack comprising:

a generally flexible and pliable backpack body formed primarily of a flexible material defining an inner cavity and having at least one shoulder strap coupled thereto, said body having a back panel and a pair of opposed sides;

a releasable fastener on a side of said body, said releasable fastener being configured such that when said releasable fastener is opened, a generally triangular flap is formed in said side of said body, said flap being pivotable away from said body to provide access to said inner cavity, and pivots about a base spaced from the back panel; and a supplemental releasable fastener on the other side of said body, said supplemental releasable fastener being configured such that when said supplemental releasable fastener is opened, a supplemental flap is formed in said other side of said body, said supplemental flap being pivotable away from said body to provide access to said inner cavity, wherein said releasable fastener and said supplemental releasable fastener each have a first portion extending generally upward and away from said back panel to an outward position distanced from the back panel, from which outward position the releasable fastener continues as a second portion that extends from the outward position upward and toward said back panel wherein said releasable fastener has a third portion that extends over a top of said body which, when opened, provides access to said inner cavity.

2. A backpack comprising:

a backpack body defining an inner cavity and having at least one shoulder strap coupled thereto, said body having a back surface, a front surface, a bottom surface, and a pair of opposed sides; and a releasable fastener on a side of said body, said releasable fastener being configured such that when said releasable fastener is opened, a generally triangular flap is formed in said side of said body, said flap being pivotable away from said body to provide access to said inner cavity, wherein said flap is flexible and pliable and pivots about a base spaced from the back panel, wherein said releasable fastener has a first portion extending generally upward and away from said bottom surface to an upper-most position distanced from the bottom surface, and a second portion that extends from the upper-most position downwardly and toward said bottom surface; wherein said releasable fastener has a third portion that extends over a top of said body which, when opened, provides access to said inner cavity; and wherein said backpack is configured to be worn by a wearer such that said at least one shoulder strap is positioned over a shoulder of the wearer, said back surface is positioned generally flat against a back of the wearer.

3. The backpack of claim 2 further comprising a releasable fastener at the top of said body which, when opened, provides access to said inner cavity.

4. The backpack of claim 3 wherein the releasable fastener at the top of said body is not connected to the releasable fastener on the side of the body.

5. The backpack of claim 2 wherein said releasable fastener is positioned substantially entirely on said side of said body and does not extend from said side of the body to the other side of the body.

6. The backpack of claim 2 wherein said flap defined by said releasable fastener covers at least 60 percent of said side of said body.

7. The backpack of claim 2 wherein said flap defined by said releasable fastener covers at least 80 percent of said side of said body.

8. A backpack comprising:

a backpack body defining an inner cavity and having at least one shoulder strap coupled thereto, said body having a back panel, a pair of opposed sides, and a top; and a releasable fastener on a side of said body, said releasable fastener being configured such that when said releasable fastener is opened, a generally triangular flap is formed in said side of said body, said flap having a base about which said flap is foldable, said base being adjacent to but spaced away from said back panel, said flap being pivotable away from said body about an axis generally parallel to said side of said body to provide access to said inner cavity, wherein said releasable fastener has a first portion extending generally upward and away from an end location adjacent to said back panel to an outward position distanced away from the back panel, from which outward position the releasable fastener continues as a second portion that extends from the outward position upward and toward said back panel to an intermediate position generally adjacent to said back panel to define said flap; and wherein said releasable fastener has a third portion that extends over said top of said body which, when opened, provides access to said inner cavity;

wherein said backpack is configured to be worn by a wearer such that said at least one shoulder strap is positioned over a shoulder of the wearer, said back panel is positioned generally flat against a back of the wearer, and said opposed sides are oriented generally vertically.

9. The backpack of claim 8 further comprising a carrying handle.

10. The backpack of claim 9 wherein said carrying handle is positioned on one or more sides of the body.

11. The backpack of claim 9 wherein said carrying handle is positioned on the top of said body.

12. The backpack of claim 8 further comprising one or more additional releasable fasteners on either side of the body.

13. The backpack of claim 12 wherein the releasable fastener at the top of said body is connected to at least one of the releasable fasteners on the side or sides of the body.

14. The backpack of claim 8 wherein said releasable fastener forms a generally "S" shape on said side of said body.

15. The backpack of claim 8 wherein said releasable fastener forms a generally serpentine shape on both sides of said body.

16. The backpack of claim 8 further comprising a supplemental releasable fastener on the other side of said body, said supplemental releasable fastener being configured such that when said supplemental releasable fastener is opened, a supplemental flap is formed in said other side of said body, said supplemental flap being pivotable away from said body to provide access to said inner cavity.

17. The backpack of claim 8 comprising two or more shoulder straps.

18. The backpack of claim 8 comprising a shoulder strap having a messenger bag configuration.

19. The backpack of claim 8 wherein said sides are oriented generally perpendicular to said back panel.

20. The backpack of claim 8 wherein said flap has a height, and wherein said base of said flap has a length that is no more than about four times as long as said height of said flap.

21. The backpack of claim 8 wherein the first and second portions form an angle therebetween of less than about eighty degrees.

22. The backpack of claim 8 wherein said back panel, pair of opposed sides, and top of the body are flexible.

* * * * *